US011273335B2

(12) United States Patent
Jenks et al.

(10) Patent No.: US 11,273,335 B2
(45) Date of Patent: Mar. 15, 2022

(54) FIRE DAMPER ACTUATOR SYSTEM

(71) Applicant: Johnson Controls Technology Company, Auburn Hills, MI (US)

(72) Inventors: Russell T. Jenks, Racine, WI (US); Kyle M. Bero, Milwaukee, WI (US); Myles S. McCaleb, Milwaukee, WI (US); Nicholas P. Prato, Milwaukee, WI (US); Stephanie P. Lynn, Milwaukee, WI (US); Kent S. Maune, Independence, MO (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 99 days.

(21) Appl. No.: 15/965,413

(22) Filed: Apr. 27, 2018

(65) Prior Publication Data

US 2018/0311519 A1 Nov. 1, 2018

Related U.S. Application Data

(60) Provisional application No. 62/491,748, filed on Apr. 28, 2017.

(51) Int. Cl.
*A62C 2/24* (2006.01)
*E05F 1/00* (2006.01)
(Continued)

(52) U.S. Cl.
CPC ..... *A62C 2/242* (2013.01); *A62C 2/14* (2013.01); *E05F 1/006* (2013.01); *A62C 2/065* (2013.01);
(Continued)

(58) Field of Classification Search
CPC ..... A62C 2/242; A62C 2/14; A62C 2/065; A62C 2/24; A62C 37/04; E05F 1/006;
(Continued)

(56) References Cited

U.S. PATENT DOCUMENTS 4,487,214 A * 12/1984 Tatum ..... A62C 2/14 137/72
9,395,099 B2 * 7/2016 Edwards ..... F24F 13/1426
(Continued)

*Primary Examiner* — Avinash A Savani
*Assistant Examiner* — Ryan L Faulkner
(74) *Attorney, Agent, or Firm* — Foley & Lardner LLP

(57) ABSTRACT

A fire damper actuation system in an HVAC system includes a damper system and an actuator system. The damper system includes damper blades rotatable between an open configuration and a closed configuration, a crank arm assembly configured to drive the damper blades, a spring assembly configured to be held in a loaded condition when the damper blades are in the open configuration, a temperature-activated fusible link, and a fusible link arm coupling the temperature-activated fusible link to the crank arm assembly. The actuator system includes a motor and a drive device. The drive device is coupled to the crank arm assembly and the temperature-activated fusible link. Operation of the drive device by the motor between a first end stop location and a second end stop location simultaneously rotates the crank arm assembly and the temperature-activated fusible link to complete a test inspection procedure.

15 Claims, 11 Drawing Sheets

(51) Int. Cl.
*A62C 2/14* (2006.01)
*E05F 15/40* (2015.01)
*A62C 2/06* (2006.01)

(52) U.S. Cl.
CPC ..... *E05F 15/40* (2015.01); *E05Y 2400/50* (2013.01); *E05Y 2900/146* (2013.01)

(58) Field of Classification Search
CPC .... E05F 15/40; E05F 1/08; E05F 1/12; E05Y 2400/50; E05Y 2900/146
USPC ..... 454/369
See application file for complete search history.

(56) References Cited

U.S. PATENT DOCUMENTS

| | | | | |
|---|---|---|---|---|
| 10,415,847 | B2 | 9/2019 | Edwards et al. | |
| 2006/0048525 | A1* | 3/2006 | Cook ..... | F24F 13/15 62/131 |
| 2020/0011566 | A1 | 1/2020 | Edwards et al. | |

* cited by examiner

FIRE DAMPER ACTUATOR SYSTEM

CROSS-REFERENCE TO RELATED PATENT APPLICATIONS

This application claims the benefit of and priority to U.S. Provisional Patent Application No. 62/491,748, filed Apr. 28, 2017, the entire disclosure of which is incorporated by reference herein.

BACKGROUND

The present disclosure relates generally to the field of hardware and control systems for fire damper equipment. More specifically, the present disclosure relates to an actuator system that may be coupled to a fire damper to allow the damper to be remotely actuated for operational testing purposes without damaging the fire damper fusible link.

SUMMARY

One implementation of the present disclosure is a fire damper actuation system in an HVAC system. The fire damper actuation system includes a damper system and an actuator system. The damper system includes damper blades rotatable between an open configuration and a closed configuration, a crank arm assembly configured to drive the damper blades, a spring assembly configured to be held in a loaded condition when the damper blades are in the open configuration, a temperature-activated fusible link, and a fusible link arm coupling the temperature-activated fusible link to the crank arm assembly. The actuator system includes a motor and a drive device. The drive device is coupled to the crank arm assembly and the temperature-activated fusible link. Operation of the drive device by the motor between a first end stop location and a second end stop location simultaneously rotates the crank arm assembly and the temperature-activated fusible link to complete a test inspection procedure.

In some embodiments, the drive device is coupled to the temperature-activated fusible link using a U-joint component.

In some embodiments, the fire damper actuation system includes a remote inspection tool communicably coupled to the actuator system and configured to transmit a control signal initiating the test inspection procedure. In other embodiments, the remote inspection tool is configured to receive motor current measurement data from the actuator system and to detect an abnormal operating condition based on the motor current measurement data. In still further embodiments, the abnormal operating condition is a broken spring assembly, an obstruction in a path of the plurality of damper blades, a broken temperature-activated fusible link, or a missing temperature-activated fusible link. In other embodiments, the remote inspection tool is a dedicated handheld device, a fire alarm system control panel component, a mobile phone, or a tablet device.

In some embodiments, the first end stop location corresponds to the open configuration of the damper blades and the second end stop location corresponds to the closed configuration of the damper blades.

In some embodiments, the crank arm assembly includes a shaft, a first pivoting linkage, and a second pivoting linkage. The second pivoting linkage is coupled to the first pivoting linkage and a damper blade to drive the damper blades between the open configuration and the closed configuration.

In some embodiments, the spring assembly includes a torsion spring.

In some embodiments, the temperature-activated fusible link is fabricated from a fusible metallic alloy.

Another implementation of the present disclosure is a method of testing a fire damper system having multiple damper blades in an HVAC system. The method includes receiving a signal to initiate a test inspection procedure from a remote inspection tool, operating a drive device between a first end stop location and a second end stop location to simultaneously rotate a crank arm assembly and a temperature-activated fusible link, measuring a current through a motor operating the drive device between the first end stop location and the second end stop location, and transmitting the motor current measurement data to the remote inspection tool.

In some embodiments, the method is performed by an actuator system.

In some embodiments, the first end stop location corresponds with an open configuration of the damper blades, and the second end stop location corresponds with a closed configuration of the damper blades.

In some embodiments, the remote inspection tool is a dedicated handheld device, a fire alarm system control panel component, a mobile phone, or a tablet device.

In some embodiments, the remote inspection tool is configured to detect an abnormal operating condition based on the motor current measurement data. In other embodiments, the abnormal operating condition is an obstruction in a path of the plurality of damper blades, a broken temperature-activated fusible link, or a missing temperature-activated fusible link.

Yet another implementation is a fire damper actuation system in an HVAC system. The fire damper actuation system includes a damper system, an actuator system, and a remote inspection tool. The damper system includes multiple damper blades rotatable between an open configuration and a closed configuration. The damper blades are normally retained in the open configuration by a temperature-activated fusible link. The actuator system includes a motor and a drive device. The drive device is coupled to the temperature-activated fusible link and is configured to drive the damper blades between the open configuration and the closed configuration. The remote inspection tool is communicably coupled to the actuator system and is configured to transmit a control signal initiating a test inspection procedure to the actuator system. The test inspection procedure includes rotation of the temperature-activated fusible link while the damper blades are simultaneously driven between the open configuration and the closed configuration.

In some embodiments, the remote inspection tool is further configured to receive motor current measurement data from the actuator system and to detect an abnormal operating condition based on the motor current measurement data. In other embodiments, the abnormal operating condition is an obstruction in a path of the damper blades, a broken temperature-activated fusible link, or a missing temperature-activated fusible link.

In some embodiments, the remote inspection tool is a dedicated handheld device, a fire alarm system control panel component, a mobile phone, or a tablet device.

DETAILED DESCRIPTION

Before turning to the FIGURES, which illustrate the embodiments in detail, it should be understood that the disclosure is not limited to the details or methodology set forth in the description or illustrated in the figures. It should also be understood that the terminology is for the purpose of description only and should not be regarded as limiting.

Referring generally to the FIGURES, an actuator system for life safety fire dampers is shown, according to some embodiments. Fire dampers are passive fire protection devices used in HVAC ducts to prevent the spread of fire inside the ductwork. In normal operation, the dampers are continuously held open by a temperature-activated fusible link. When a rise in temperature occurs due to a fire, the fusible link is designed to fail and allow a spring assembly to close the dampers, restricting airflow though the duct and limiting the ability of the fire to spread.

Depending on the local building code, fire dampers must undergo periodic operational testing. Per the National Fire Protection Association (NFPA) standard 80 that is referenced by most municipalities, every fire damper must be tested and inspected one year after installation, and then every four or six years depending on the building type. Operational testing of fire dampers can be highly resource-intensive—since the dampers are located in ceiling ductwork, access can be difficult and messy. For example, when the testing is completed in hospitals, building zones must be selectively masked off in order to protect patients from unsettled dust and debris when ceiling panels are disturbed. Once the dampers are accessible to technicians, test cycling of the dampers involves removing the fusible link, confirming that the damper closes completely without assistance, and returning the damper to a fully open position, taking care to ensure that the fusible link is not damaged in the process. Often, building owners are faced with the choice of complying with the onerous testing procedure or taking the risk of noncompliance with building codes.

The actuator system depicted in the FIGURES is a low cost addition to an existing fire damper system that permits a building owner to remotely confirm the operational status of the dampers without visual verification of their operation. Instead of manually removing the fusible link and confirming proper closure of the dampers, an actuator system rotates the dampers to a closed position and back without damaging or requiring removal of the fusible link. Control signals for the actuator system may be sent remotely via wired or wireless means, either from a handheld test verification tool or an existing fire alarm panel.

Figure 1:
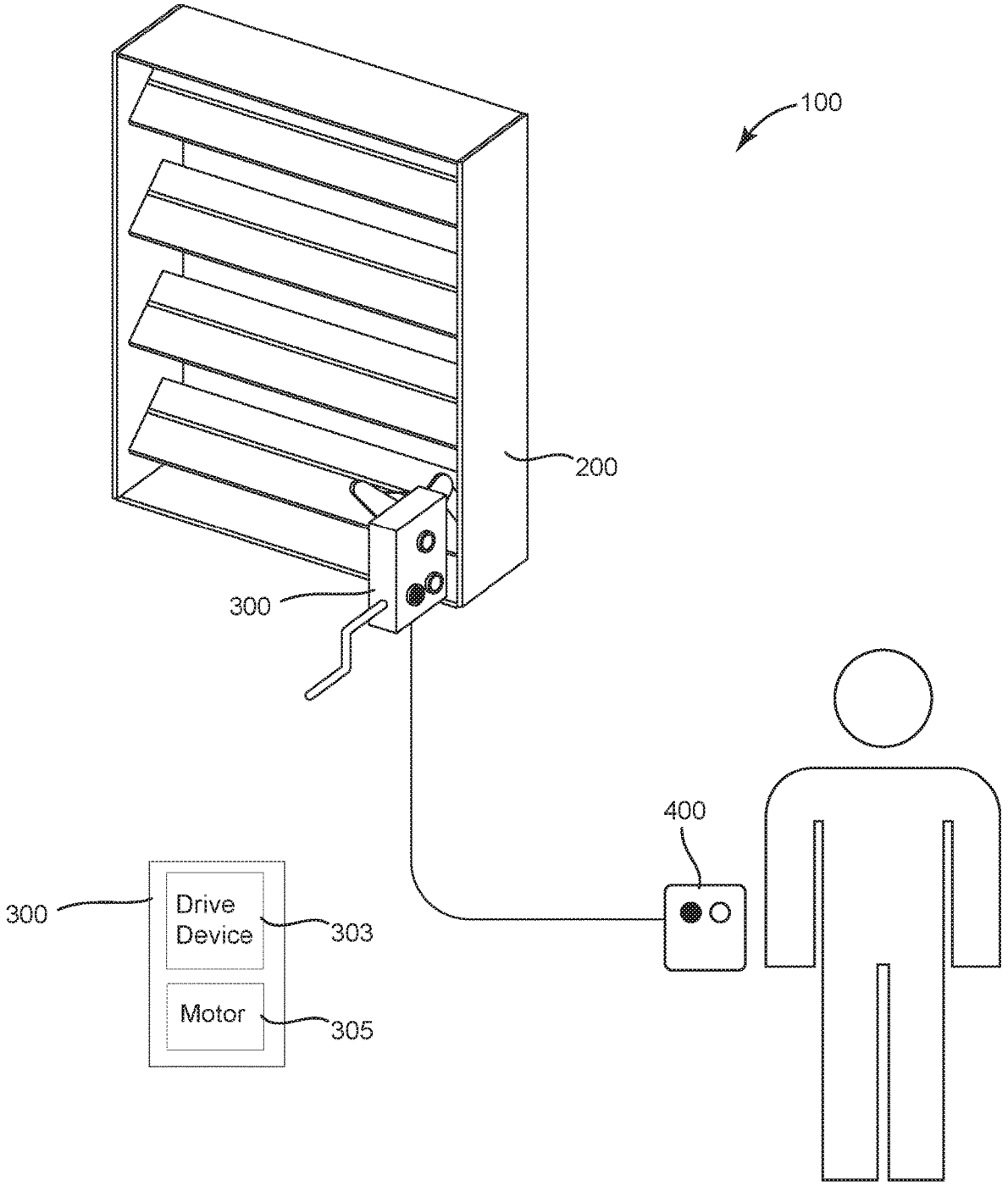
FIG. 1 is a depiction of a fire damper actuator system, according to an example embodiment.

Referring to FIG. 1, a diagram of a fire damper actuator system 100 is depicted, according to some embodiments. Fire damper actuator system 100 is shown to include a damper system 200, an actuator system 300, and a remote inspection tool 400. Described in further detail below with reference to FIGS. 2-7, damper system 200 may be any type of fire damper assembly (e.g., a blade-style assembly, a curtain-style assembly). Actuator system 300 may include any type of electric actuator having a motor 305 and a drive device 303 that is used to actuate the components of an HVAC system (e.g., a linear actuator, a linear proportional actuator, a non-linear actuator, a spring return actuator, a non-spring return actuator).

Remote inspection tool 400 may be a device that permits a user to initiate a damper test and determine whether the test was successfully completed using wired or wireless communications without necessitating a view of the damper itself. For example, remote inspection tool 400 may include one or more components configured to receive user input (e.g., a "Begin Test" button, a "Pause Test" button). Remote inspection tool 400 may further include a visible test indicator or interface (e.g., red and green colored lights, a status and/or parameter display screen, an error display screen) that indicate the results of the test and/or the damper status. For example, the parameter display screen may indicate whether the damper system 200 is in an open configuration, a closed configuration, or a partially closed configuration. In various embodiments, remote inspection tool may be a dedicated handheld device or an integrated component of a fire alarm system control panel. Power for the actuator system 300 may be supplied from the handheld device or the control panel. In other embodiments, remote inspection tool 400 may be a mobile device (e.g., a mobile phone, a tablet), and actuator system 300 may include a smart actuator configured to receive and transmit wireless signals to and from the mobile device or a building automation system (BAS) controller.

Figure 2:
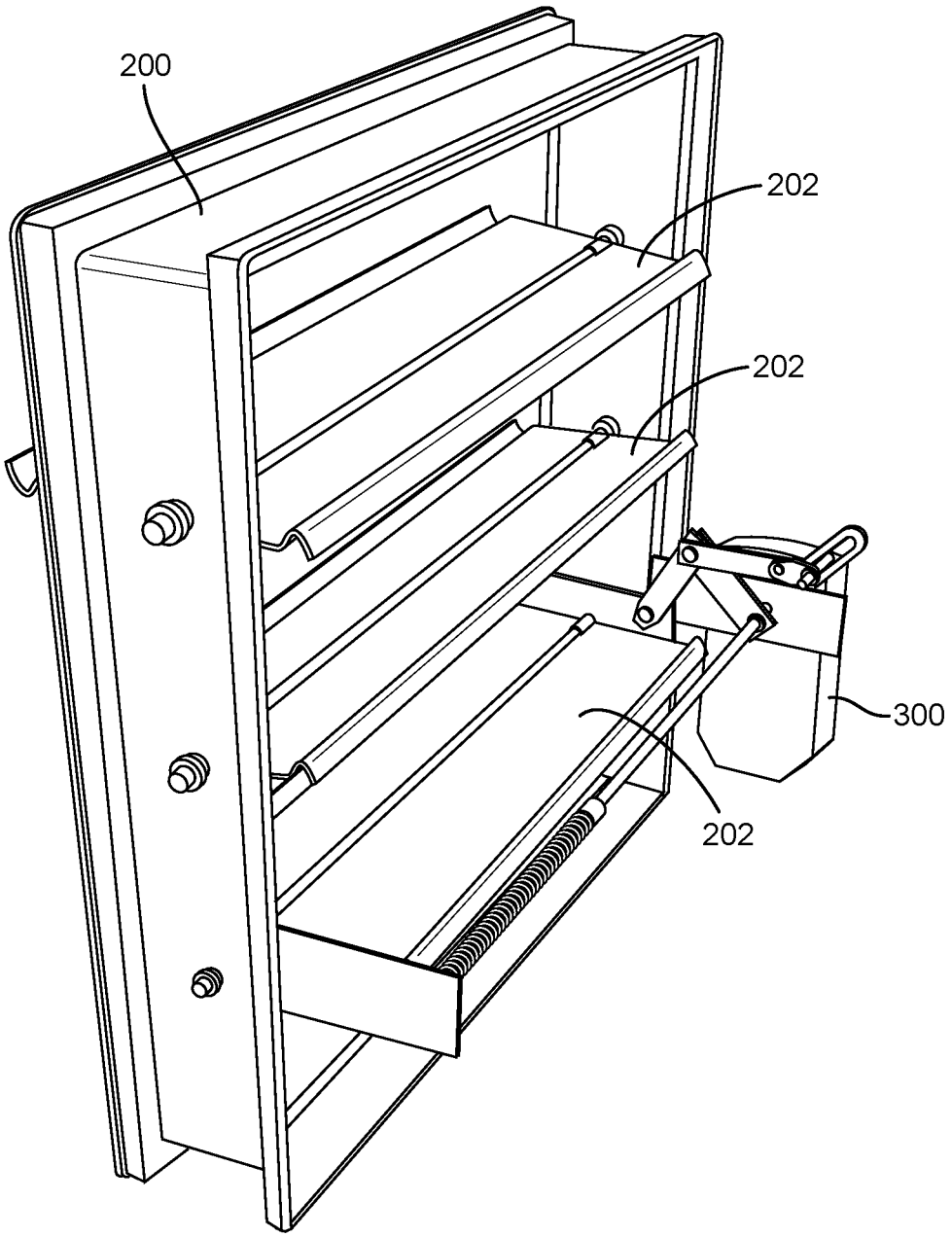
FIG. 2 is a perspective view of the fire damper actuator system of FIG. 1 in an open configuration, according to some embodiments.
Figure 3:
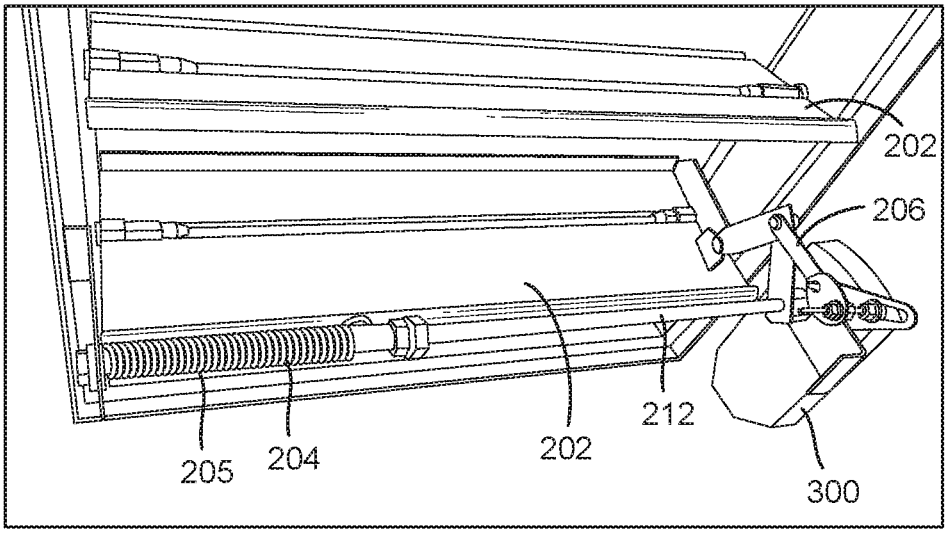
FIG. 3 is another perspective view of the fire damper actuator system of FIG. 1 in an open configuration, according to some embodiments.
Figure 4:
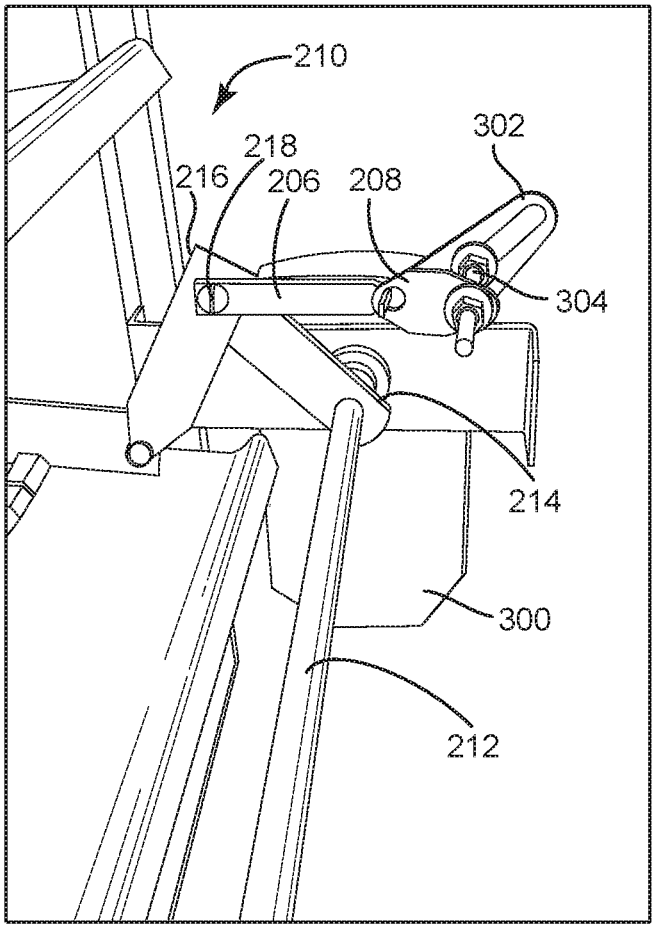
FIG. 4 is another perspective view of the fire damper actuator system of FIG. 1 in an open configuration, according to some embodiments.

Turning now to FIGS. 2-4, images of the fire damper actuator system 100 in an open configuration are depicted, according to some embodiments. As shown, damper system 200 includes a plurality of damper blades 202. Damper blades 202 may be rotatably coupled to a frame that retains the blades within a building duct. In an open configuration, damper blades 202 may be substantially parallel to the direction of air flowing through the building duct. Damper system 200 further includes a spring assembly 204, a fusible link arm 206, a fusible link 208, and a crank arm assembly 210. The crank arm assembly 210 is shown to include a shaft 212, a first pivoting linkage 214, and a second pivoting linkage 216. The shaft 212 may be coupled to a drive device 303 of the actuator system 300 such that rotation of the drive device 303 causes rotation of the shaft 212. In addition, the first pivoting linkage 214 may be fixedly coupled to the shaft 212 such that rotation of the shaft 212 causes rotation of the first pivoting linkage 214. The second pivoting linkage 216 may be pivotably coupled to both a damper blade 202 and to the first pivoting linkage 214. The first pivoting linkage 214 and the second pivoting linkage 216 may be joined at pivot point 218. As shown, pivot point 218 may also serve as a point of attachment for the fusible link arm 206 in order to couple the fusible link 208 to the crank arm assembly 210.

The spring assembly 204 may be configured to work in concert with the crank arm assembly 210. In some embodiments, the spring assembly 204 includes a torsion spring 205 that is coupled to the shaft 212. When the fire damper actuator system 100 is in its open configuration, the spring assembly 204 may be held in a wound or loaded state. Upon failure of the fusible link 208 and subsequent release of fusible link arm 206, the spring assembly 204 may unwind and cause the crank arm assembly 210 to drive the damper blades 202 to the closed position. In some embodiments, fusible link 208 may be fabricated in whole or in part from a fusible metallic alloy that is designed to melt (i.e., fail) at a specific temperature (e.g., 165° F., 212° F.).

Figure 6:
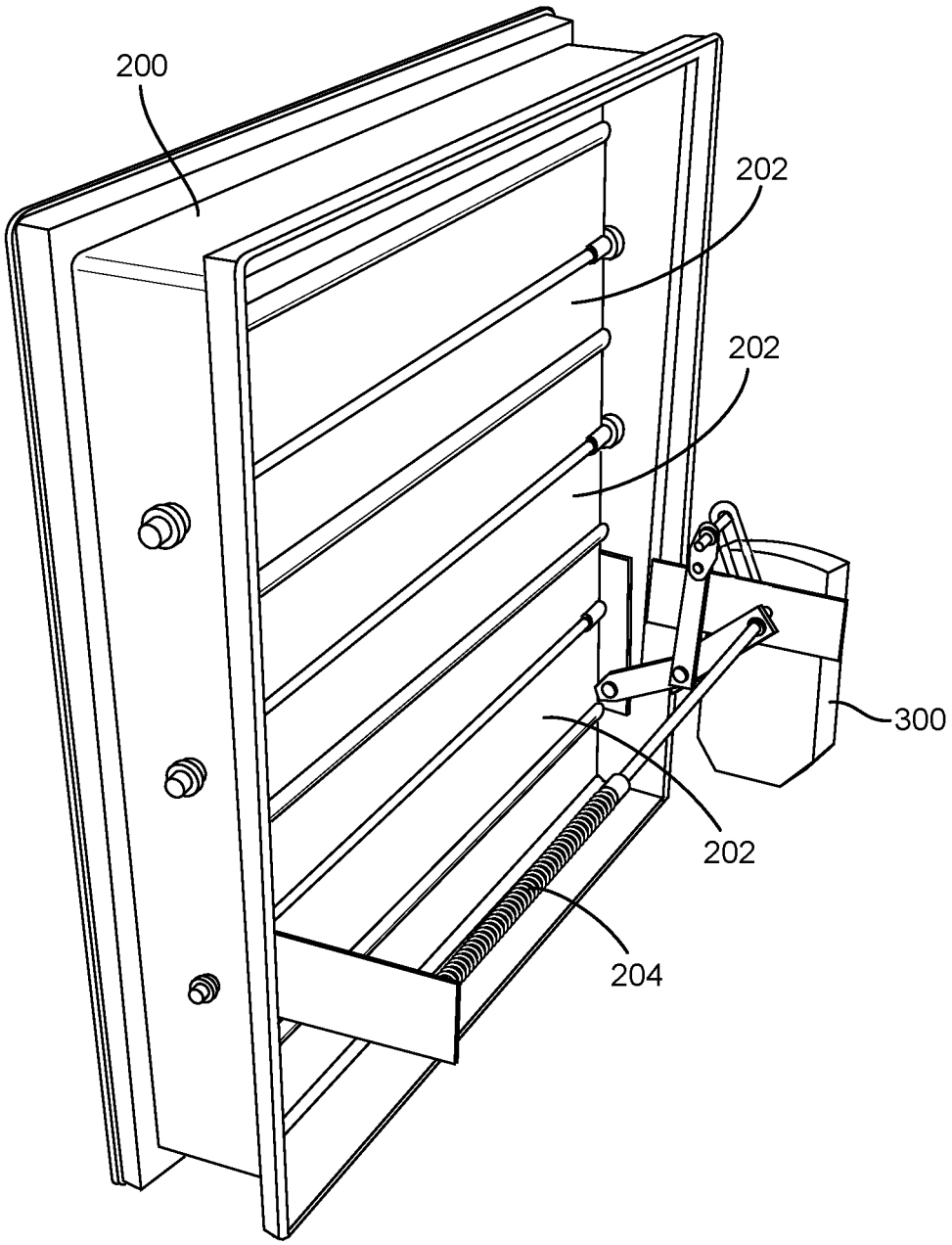
FIG. 6 is a perspective view of the fire damper actuator system of FIG. 1 in a closed configuration, according to some embodiments.

Actuator system 300 may include a U-joint 303 rotatable by the drive device 303 of the actuator. Actuator system 300 may further include securing hardware 305 used to couple U-joint 303 to fusible link 208. In some embodiments, securing hardware 305 may include one or more bolts, pins, nuts, and washers. As U-joint 303 rotates from an open blade position (with its end pointing away from the damper blades 202, as depicted in FIG. 4) to a closed blade position (with its end pointing towards the damper blades 202, as depicted in FIG. 6), fusible link arm 206 and fusible link 208 rotate with U-joint 303. In other words, fusible link arm 206 and fusible link 208 rotate from a substantially horizontal position when the damper blades are opened to a substantially vertical position when the damper blades are closed This results in an operational test for the damper blades 202 that causes no damage to fusible link 208.

Figure 5:
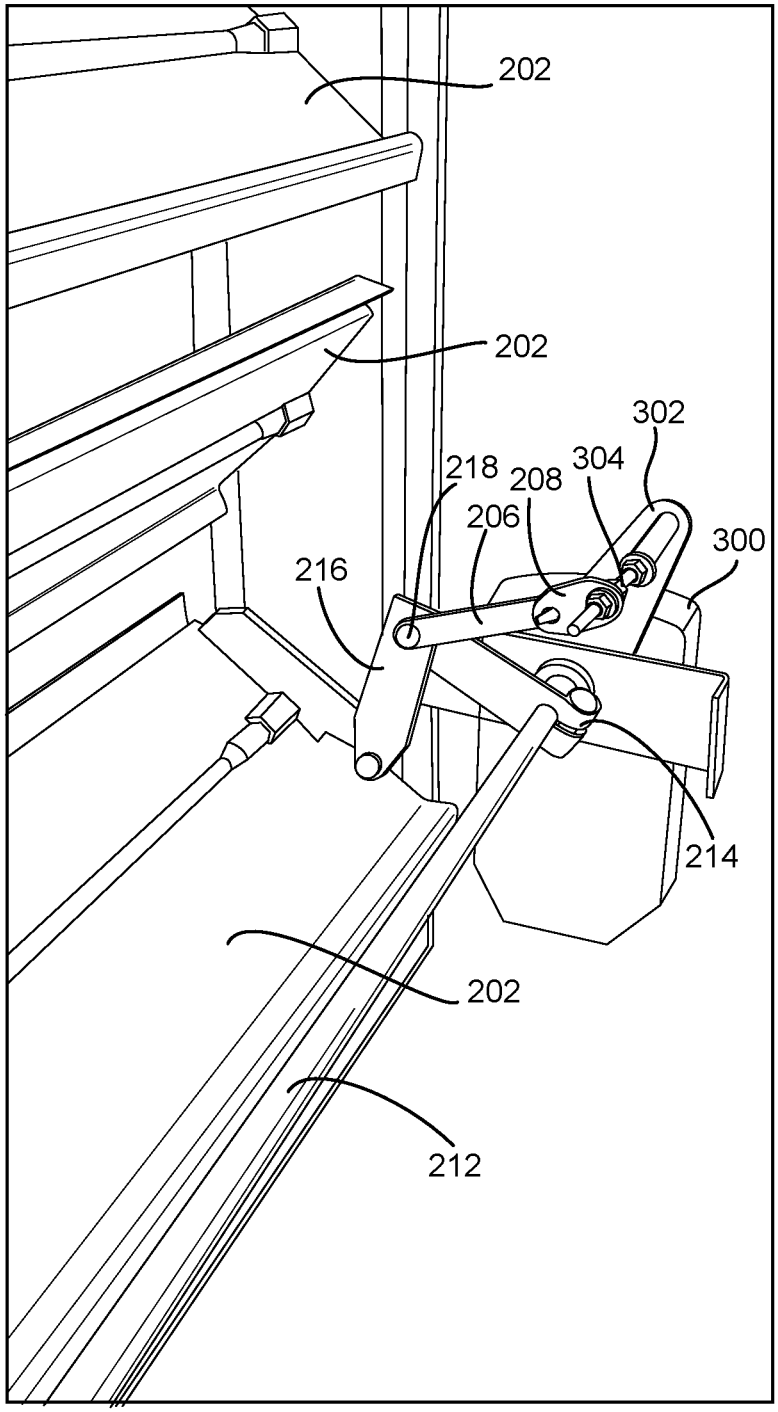
FIG. 5 is a perspective view of the fire damper actuator system of FIG. 1 in a partially closed configuration, according to some embodiments.

Referring now to FIG. 5, an image of the fire damper actuator system 100 in a partially closed configuration is depicted, according to some embodiments. As shown, rotation of the first pivoting linkage 214 causes the second pivoting linkage 216 to rotate at the pivot point 218 and drive the damper blades 202 into a partially closed configuration. In the partially closed configuration, the damper blades 202 are no longer parallel to the direction of air flow through the duct. Instead, blades 202 may be inclined toward each other, resulting in a partial obstruction of the airflow path though the duct. In addition, U-joint 302 may be located midway between its open and closed positions.

Figure 7:
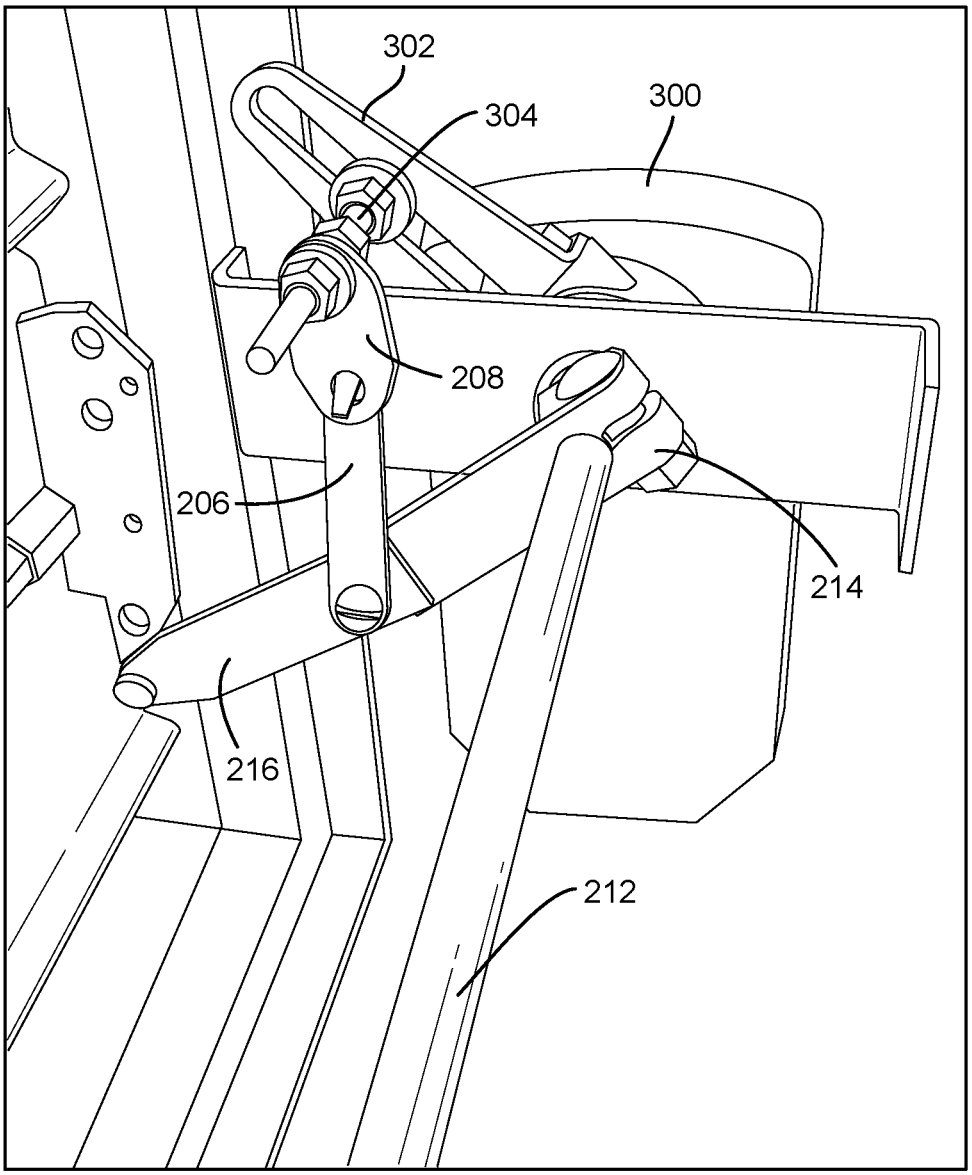
FIG. 7 is another perspective view of the fire damper actuator system of FIG. 1 in a closed configuration, according to some embodiments.

Turning now to FIGS. 6-7, images of the fire damper actuator system 100 in a closed configuration are depicted, according to some embodiments. As shown, in the closed configuration, first pivoting linkage 214 and second pivoting linkage 216 of the crank arm assembly 210 are substantially parallel, which drives the rotation of the damper blades 202 such that they are substantially parallel to each other and perpendicular to the airflow path through damper system 200, thereby impeding the airflow past the damper system 200 and preventing the spread of a fire. Fusible link arm 206 and fusible link 208 may be in a substantially vertical position, and the end of U-joint 303 may be pointing towards damper blades 202. Once remote inspection tool 400 receives data from actuator system 300 indicating that damper blades 202 have successfully reached their closed configuration, the drive device 303 of actuator system 300 may reverse its travel, returning damper system 200 to the open configuration depicted in FIGS. 2-4 and reloading the spring assembly 204. In some embodiments, as described in greater detail below with reference to FIGS. 8-11, the data transmitted from the actuator system 300 and received by the remote inspection tool 400 includes motor current and/or motor voltage measurements.

Figure 8:
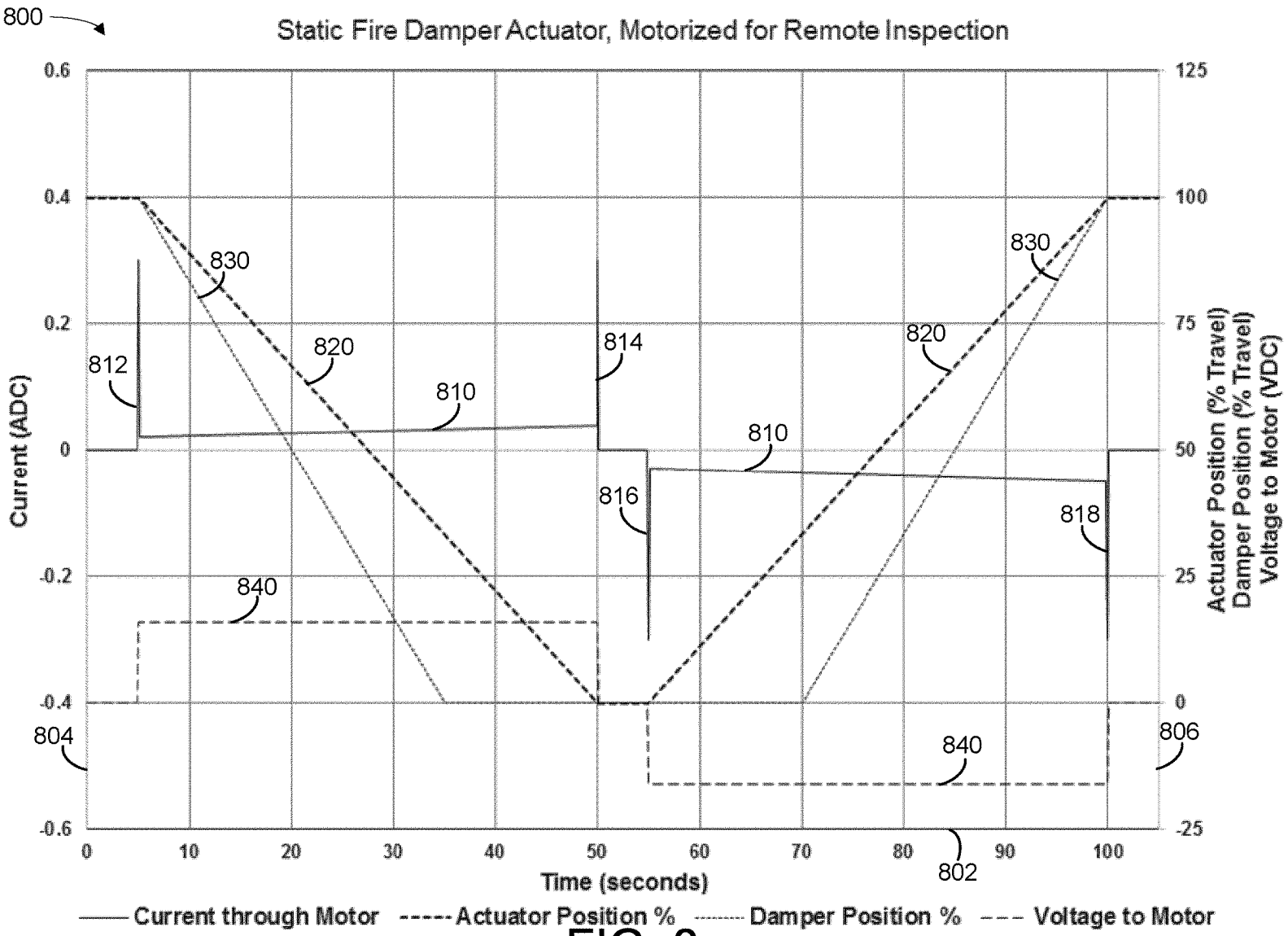
FIG. 8 is a plot of the motor current, actuator position, damper position, and motor voltage of the fire damper actuator system of FIG. 1 over the entire stroke length of the actuator in a normal operating condition, according to some embodiments.

Referring now to FIG. 8, a plot 800 of various parameters related to the fire damper actuator system 100 under normal operating conditions is shown, according to some embodiments. In various embodiments, these parameters may include the actuator motor current 810 (represented in amps DC [ADC] on axis 804), the actuator position 820 (represented in percentage travel on axis 806), the damper position 830 (represented in percentage travel on axis 806), and the actuator motor voltage 840 (represented in volts DC [VDC] on axis 806). Each of the parameters 810-840 is plotted along a time axis 802 that represents the entire stroke length of the actuator (i.e., damper blade positions that progress from fully open, to fully closed, and back to fully open). Positive values of the actuator motor current 810 and the actuator motor voltage 840 occur when the motor 305 of the actuator system 300 is driving the damper blades 202 from the open position to the closed position (i.e., when the spring assembly 204 is unwinding from a loaded state), negative values of the actuator motor current 810 and the actuator motor voltage 840 occur when the motor 305 of the actuator system 300 is driving the damper blades 202 from the closed position to the open position (i.e., when the spring assembly 204 is rewinding).

In various embodiments, parameters 810-840 may be displayed on the a user interface (e.g., a display screen) of the remote inspection tool 400. In other embodiments, another computing device (e.g., a laptop, a tablet, a mobile device) may be communicably coupled to the remote inspection tool 400 to display the parameters 810-840. In some embodiments, the fire damper actuator system 100 includes feedback sensors to measure and communicate the actuator position 820 and the damper position 830 to the remote inspection tool 800. In other embodiments, the fire damper actuator system 100 does not include feedback sensors that directly measure the actuator position 820 and the damper position 830. Rather, as described below, the actuator and/or damper positions may be determined based on the actuator motor current 810. Monitoring of the actuator and/or damper positions via the actuator motor current 810 may permit the detection of a variety of faults in the actuator system 100 without the added expense of additional feedback sensors.

Thus, in some embodiments, the actuator motor current 810 may be the sole monitored parameter to ensure proper functioning of the fire damper actuator system 100. For example, when the damper blades 202 are traveling from the open configuration to the closed configuration, the motor current 810 increases as the damper blades 202 close because the spring assembly 204 is unwinding from its loaded state. There is less aiding load on the actuator system 300 as it drives, which is more torque at the motor 305 of the actuator system 300. Similarly, when the damper blades 202 travel from the closed configuration to the open configuration, the motor current 810 increases because spring assembly 204 is rewinding and causing an increase of torque at the motor 305 of the actuator system 300. In other words, the slope(s) of the measured motor current 810 may provide an indication that the fire damper actuator system 100 is not experiencing mechanical problems.

Still referring to FIG. 8, as depicted in the plots of actuator position 820 and damper position 830, the damper blades 202 may reach their fully closed position before actuator reaches its end stop location, accounting for the discrepancy between the time at which actuator position 820 and damper position 830 reach 0% travel. Extreme values of the actuator motor current 810 (e.g., the spikes depicted at 812, 814, 816, and 818) may indicate when the motor 305 of actuator system 300 has started from rest (i.e., current spikes 812 and 816) and when the motor 305 has reached its internal end stop locations (i.e., current spikes 814 and 818).

Figure 9:
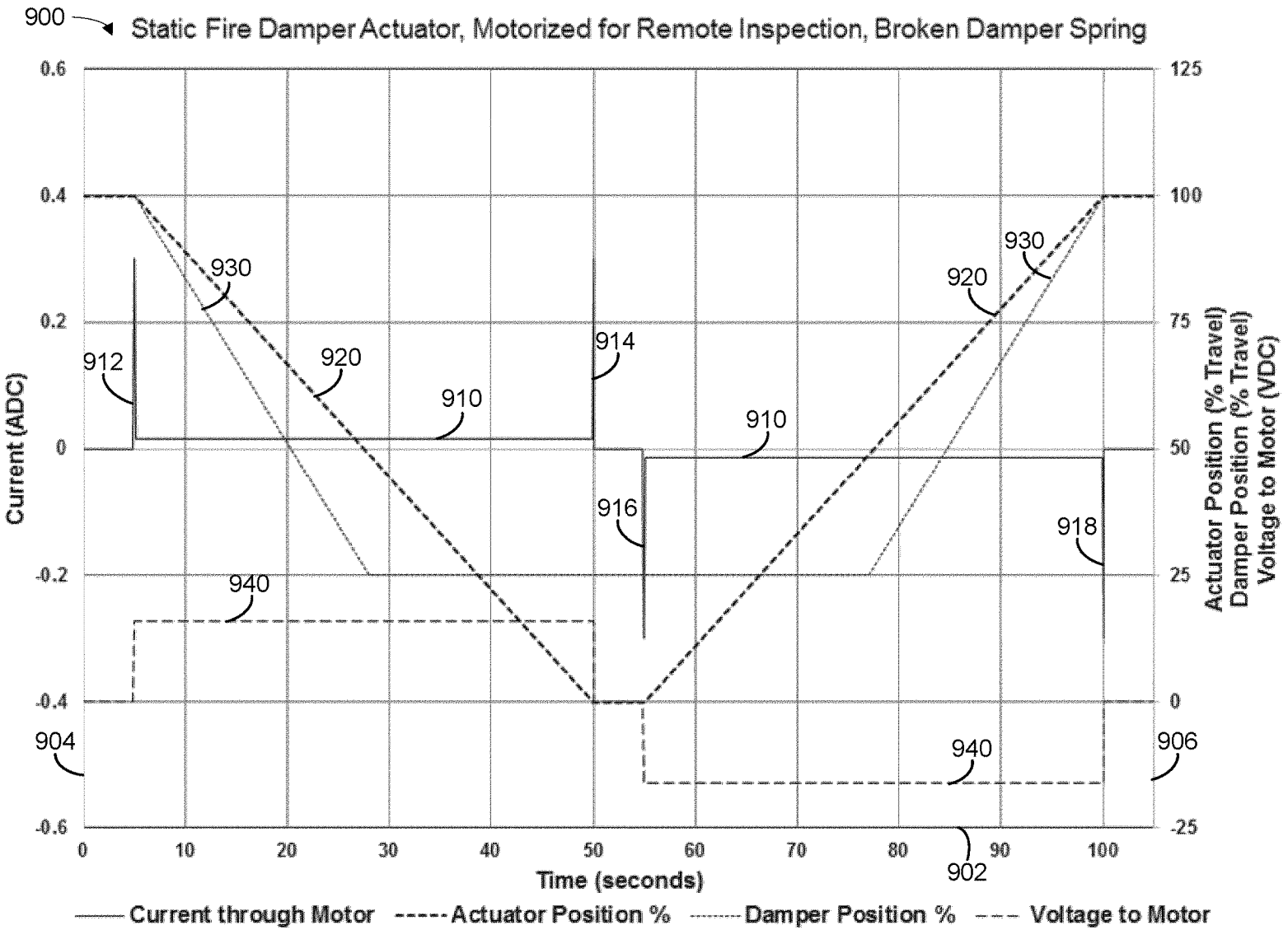
FIG. 9 is a plot of the motor current, actuator position, damper position, and motor voltage of the fire damper actuator system of FIG. 1 in a broken damper spring condition, according to some embodiments.
Figure 10:
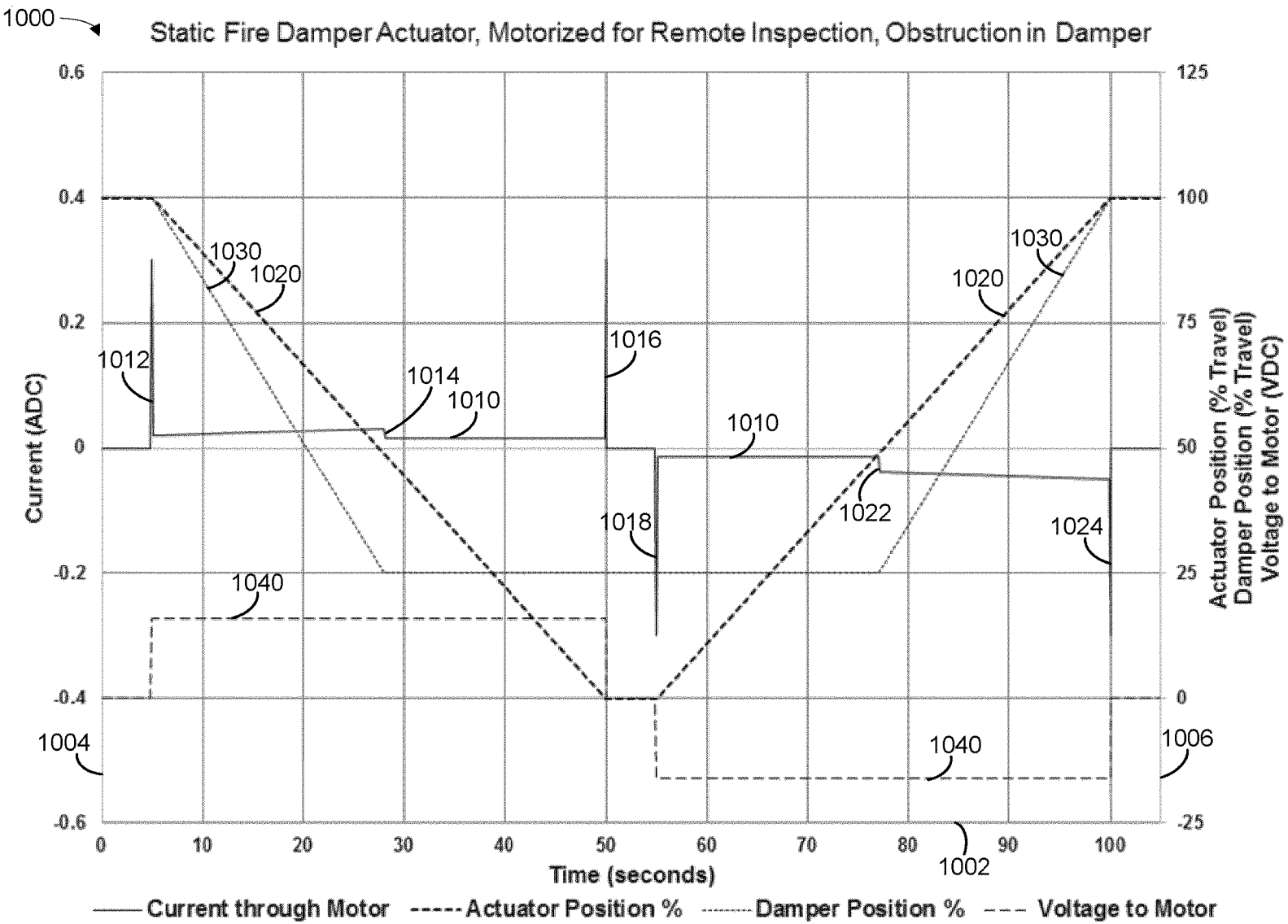
FIG. 10 is a plot of the motor current, actuator position, damper position, and motor voltage of the fire damper actuator system of FIG. 1 in a damper obstruction condition, according to some embodiments.
Figure 11:
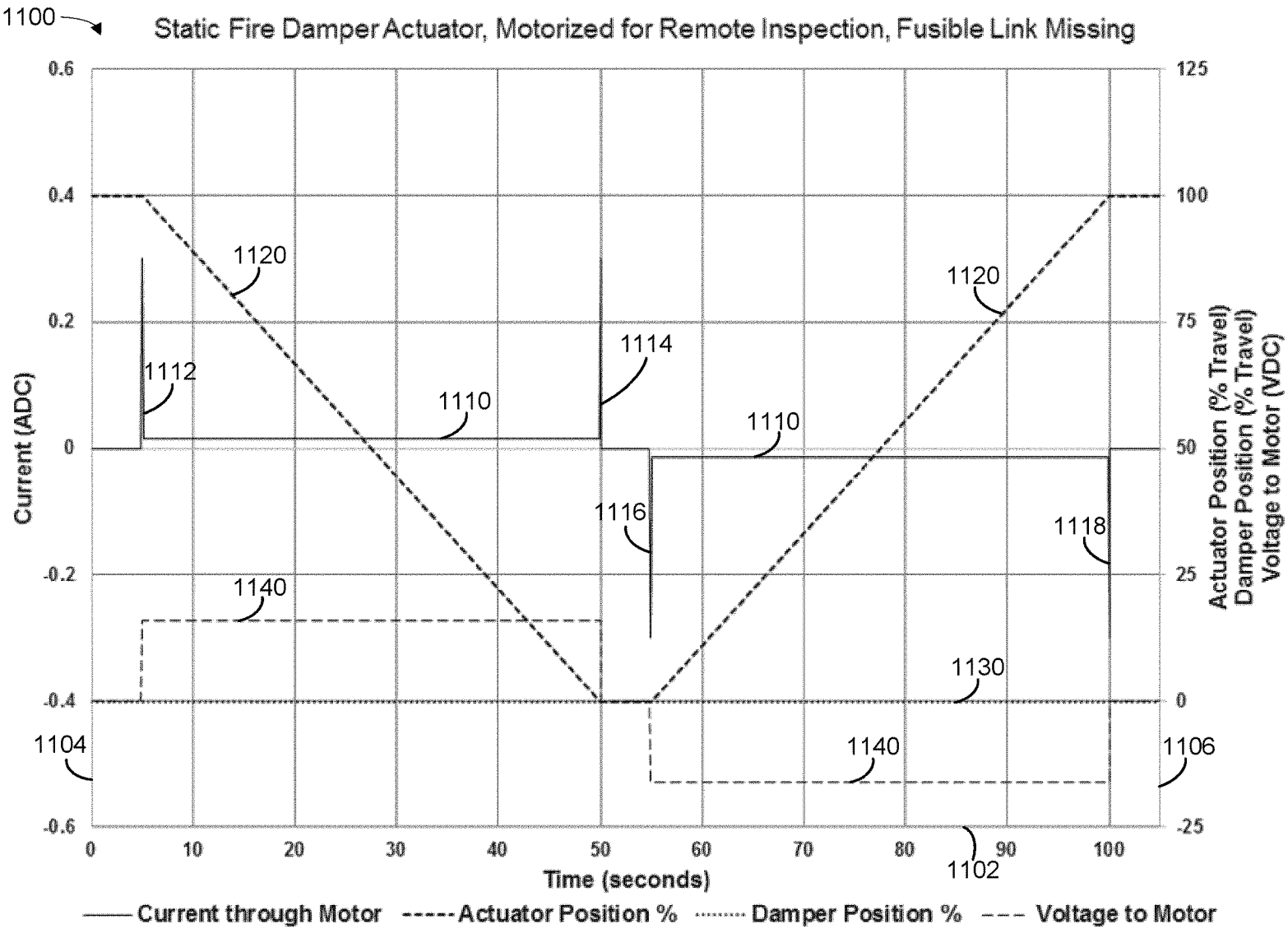
FIG. 11 is a plot of the motor current, actuator position, damper position, and motor voltage of the fire damper actuator system of FIG. 1 in a missing fusible link condition, according to some embodiments.

Turning now to FIGS. 9-11, plots of parameters related to the fire damper actuator system 100 under various abnormal operating conditions are shown, according to some embodiments. Specifically, FIG. 9 depicts parameters of a fire damper actuator system 100 having a broken spring assembly 204, FIG. 10 depicts parameters of a system 100 having an obstruction in the path of the damper blades 202, and FIG. 11 depicts parameters of a system 100 having a fusible link 208 that has broken or is otherwise detached from the crank arm assembly 210.

As shown in FIG. 9 and similar to FIG. 8 described above, plot 900 depicts actuator motor current 910 on axis 904, as well as actuator position 920, damper position 930, and actuator motor voltage 940 on axis 906. Moving along the time axis 902, the motor current 910 is shown to include current spikes 912 and 916 where the motor 305 of actuator system 300 has started from rest, as well as current spikes 914 and 918 where the motor 305 has reached internal end stop locations. However, as the actuator position 920 varies between its end stop locations (i.e., from 5 seconds to 50 seconds and from 55 seconds to 100 seconds on time axis 902), the value of the motor current 910 is shown to be static rather than increasing, and the damper position 930 is shown to stall 25% of the length of its full travel from a fully closed position, between approximately 28 seconds and 78 seconds on time axis 902. Thus, a broken spring assembly 204 preventing the plurality of damper blades 202 from reaching a fully closed configuration may be indicated by static motor current data 910.

Referring now to FIG. 10, a plot 1000 of parameters of a fire damper actuator system 100 having obstructed damper blades 202 is shown, according to some embodiments. Similar to plots 800 and 900, plot 1000 depicts actuator motor current 1010 on axis 1004, as well as actuator position 1020, damper position 1030, and actuator motor voltage 1040 on axis 1006. Moving along the time axis 1002, the motor current 1010 is shown to include a current spike 1012 when the motor 305 of the actuator system 300 begins operating from rest, at approximately 5 seconds on the time axis 1002. At approximately 28 seconds, the damper position 1030 is shown to stall 25% of the length of its full travel from a fully closed position (i.e., the damper blades 202 remain in a partially open configuration). At the same time, a first motor current discontinuity 1014 occurs, and the motor current 1010 remains static until the actuator position 1020 reaches its end stop location at 50 seconds. This is because the spring assembly 204 is prevented from aiding the motor 305 past the point of stall. At 50 seconds, the motor current 1010 includes a current spike 1016 when the actuator position 1020 reaches its end stop location, and another current spike 1018 occurs at 55 seconds when the actuator begins its travel from rest in the opposite direction. At approximately 78 seconds on the time axis 1002, a second motor current discontinuity 1022 occurs when the actuator reaches the point of the damper blade obstruction. From 78 seconds through the end of the test procedure (i.e., 100 seconds on the time axis 1002) the spring assembly 204 resumes rewinding and the motor current 1010 increases normally until the actuator position 1020 reaches its end stop location and a final motor current spike 1024 occurs.

Turning now to FIG. 11, a plot 1100 of parameters of a fire damper actuator system 100 having a broken or missing fusible link 208 is shown, according to some embodiments. Just as in FIGS. 8-10, plot 1100 depicts actuator motor current 1110 on axis 1104, as well as actuator position 1120, damper position 1130, and actuator motor voltage 1140 on axis 1106. Similar to plot 900 depicting the fire damper actuator system 100 having a broken spring assembly 204, actuator motor current 1110 is shown to be static aside from the motor current spikes at 1112, 1114, 1116, and 1118. However, in contrast to plot 900, the damper position 1130 is shown to be static, indicating that the damper blades 202 in the closed configuration across the entire actuator travel indicated by actuator position 1120. This is because the absence or failure of the fusible link 208 to retain the damper blades 202 in the open configuration causes the spring assembly 204 to unwind and the crank assembly 210 to drive the damper blades 202 into the closed configuration. Although the broken or missing fusible link failure condition cannot be immediately distinguished from a broken spring failure condition through examination of the motor current data alone, both failure conditions may prompt manual inspection that leads to resolution of the failure condition.

Figure 12:
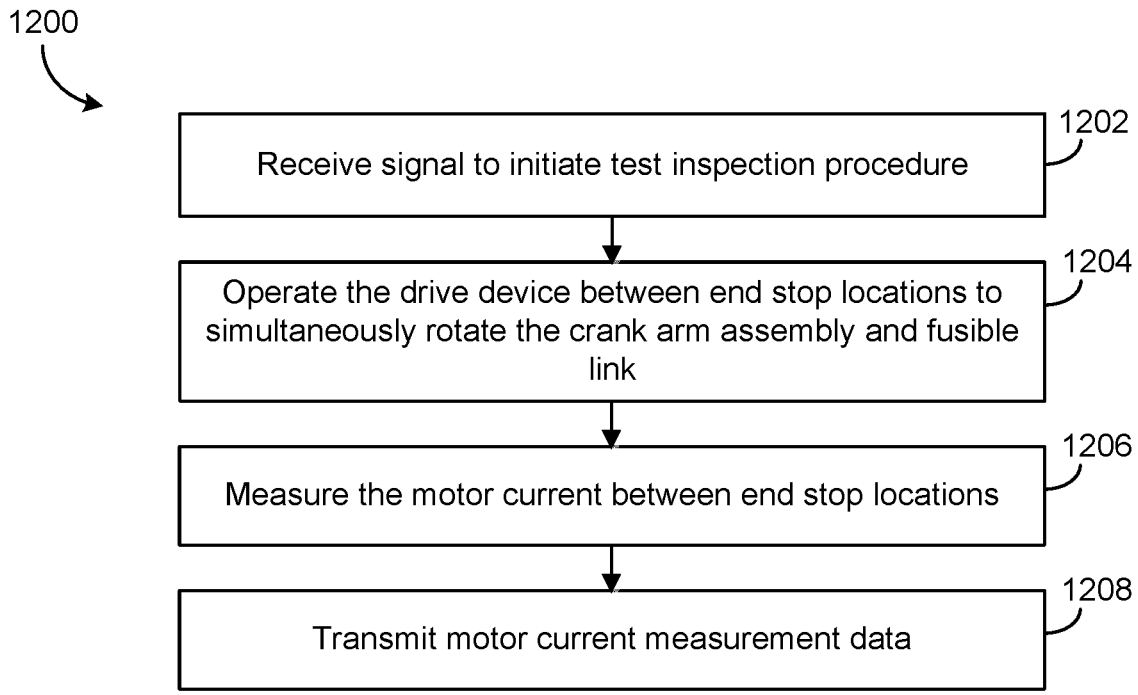
FIG. 12 is a flow chart of a process for completing a test inspection procedure using the fire damper actuator system of FIG. 1, according to some embodiments.

Referring now to FIG. 12, a flow chart of a process 1200 for completing a test inspection procedure for the fire damper actuator system 100 is shown. In some embodiments, the process 1200 is performed at least in part by the actuator system 300. Process 1200 is shown to commence with step 1202, in which the actuator system 300 receives a control signal to initiate the test inspection procedure. In some embodiments, the control signal is generated by the remote inspection tool 400. At step 1204, the actuator system 300 operates the motor 305 of the actuator system 300 to drive the drive device 303 between end stop locations. Operating the drive device 303 between end stop locations may include driving the damper blades 202 from the open configuration (e.g., depicted in FIGS. 2-4) to the closed configuration (e.g., depicted in FIGS. 6-7) and back to the open configuration. As the damper blades 202 are driven between the open configuration and the closed configuration through operation of the crank arm assembly, the fusible link 208 is simultaneously rotated by the drive device 303 to prevent damage or failure to the fusible link 208.

At step 1206, the actuator system 300 measures the current supplied to the motor 305 of the actuator system 300 as the drive device 303 is operated between its end stop locations. In some embodiments, the measured motor data is identical or substantially similar to the motor current data presented in plots 800-1100 described above with reference to FIGS. 8-11. Finally, process 1200 ends at step 1208 as the actuator system 300 transmits the motor current measurement data to an external device. In some embodiments, the external device is the remote inspection tool 400. For example, the remote inspection tool 400 may be configured to automatically recognize failure modes or abnormal operating conditions based on the motor current data. In other embodiments, a user of the remote inspection tool 400 may be trained to manually detect failure modes and abnormal operating conditions.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A fire damper actuation system in an HVAC system, the fire damper actuation system comprising: a damper system comprising: a plurality of damper blades rotatable between an open configuration and a closed configuration; a crank arm assembly configured to drive the plurality of damper blades between the open configuration and the closed configuration, the crank arm assembly comprising: a first pivoting linkage, a second pivoting linkage pivotally coupled to the first pivoting linkage and at least one of the plurality of damper blades, and a shaft coupled to the first pivoting linkage; a spring assembly coupled to the crank arm assembly and configured to be held in a loaded condition when the plurality of damper blades are in the open configuration; a temperature-activated fusible link configured to fail when the temperature-activated fusible link is proximate to a fire; and a fusible link arm coupled to the temperature-activated fusible link and pivotally coupled to the first pivoting linkage and the second pivoting linkage; and an actuator system comprising a motor and a drive device, the drive device coupled to the shaft, wherein operation of the drive device by the motor between a first end stop location and a second end stop location simultaneously rotates the crank arm assembly and the temperature-activated fusible link to complete a test inspection procedure, and wherein a remote inspection tool in communication with the actuator system is configured to transmit a control signal initiating a test inspection procedure to the actuator system and is configured to: receive at least one of a plurality of current values or a plurality of voltage values from the actuator system, determine that the actuator system has failed based on the at least one of the plurality of current values or the plurality of voltage values, and receive motor current measurement data from the actuator system, and detect an abnormal operating condition based on the motor current measurement data.

2. The fire damper actuation system of claim 1, wherein the drive device is coupled to the temperature-activated fusible link using a joint component.

3. The fire damper actuation system of claim 1, wherein the abnormal operating condition is at least one of a broken spring assembly, an obstruction in a path of the plurality of damper blades, a broken temperature-activated fusible link, or a missing temperature-activated fusible link.

4. The fire damper actuation system of claim 1, wherein the remote inspection tool is at least one of a dedicated handheld device, a fire alarm system control panel component, a mobile phone, or a tablet device.

5. The fire damper actuation system of claim 1, wherein the first end stop location corresponds to the open configuration of the plurality of damper blades and the second end stop location corresponds to the closed configuration of the plurality of damper blades.

6. The fire damper actuation system of claim 1, wherein the spring assembly comprises a torsion spring.

7. A fire damper actuation system of claim 1, wherein the temperature-activated fusible link is fabricated from a fusible metallic alloy.

8. A method of testing a fire damper system including a damper system and a remote inspection tool, the damper system having a plurality of damper blades, a drive device, a motor operating the drive device, a crank arm assembly, and a temperature-activated fusible link, the method comprising:

providing, by the remote inspection tool, a signal to initiate a test inspection procedure of the damper system;

operating, by the damper system, the drive device between a first end stop location and a second end stop location to simultaneously rotate the crank arm assembly and the temperature-activated fusible link;

measuring, by the damper system, a plurality of current values for a current through the motor; and transmitting, by the damper system, the plurality of current values to the remote inspection tool; and determining, by the remote inspection tool, that the damper system has failed based on the plurality of current values.

9. The method of claim 8, wherein the first end stop location corresponds with an open configuration of the plurality of damper blades, and the second end stop location corresponds with a closed configuration of the plurality of damper blades.

10. The method of claim 8, wherein the remote inspection tool is at least one of a dedicated handheld device, a fire alarm system control panel component, a mobile phone, or a tablet device.

11. The method of claim 8, wherein the remote inspection tool is configured to detect an abnormal operating condition based on the plurality of current values.

12. The method of claim 11, wherein the abnormal operating condition is at least one of an obstruction in a path of the plurality of damper blades, a broken temperature-activated fusible link, or a missing temperature-activated fusible link.

13. A fire damper actuation system in an HVAC system, the fire damper actuation system comprising: a damper system comprising a plurality of damper blades rotatable between an open configuration and a closed configuration, the plurality of damper blades normally retained in the open configuration by a temperature-activated fusible link; and an actuator system comprising a motor and a drive device, the drive device coupled to the temperature-activated fusible link and configured to drive the plurality of damper blades between the open configuration and the closed configuration; and a remote inspection tool in communication with the actuator system and configured to transmit a control signal initiating a test inspection procedure to the actuator system and configured to: receive at least one of a plurality of current values or a plurality of voltage values from the actuator system, determine that the actuator system has failed based on the at least one of the plurality of current values or the plurality of voltage values, receive motor current measurement data from the actuator system, and detect an abnormal operating condition based on the motor current measurement data; wherein the test inspection procedure comprises rotation of the temperature-activated fusible link while the plurality of damper blades are simultaneously driven between the open configuration and the closed configuration.

14. The fire damper actuation system of claim 13, wherein the abnormal operating condition is at least one of an obstruction in a path of the plurality of damper blades, a broken temperature-activated fusible link, or a missing temperature-activated fusible link.

15. The fire damper actuation system of claim 13, wherein the remote inspection tool is at least one of a dedicated handheld device, a fire alarm system control panel component, a mobile phone, or a tablet device.

* * * * *